US010825625B1

(12) United States Patent
Marshall et al.

(10) Patent No.: US 10,825,625 B1
(45) Date of Patent: Nov. 3, 2020

(54) KINETIC ACTUATOR FOR VACUUM INTERRUPTER

(71) Applicant: Smart Wires Inc., Union City, CA (US)

(72) Inventors: Trevor B. Marshall, Nottingham (GB); Michael J. Saunders, Hucknall (GB); Haroon Inam, San Jose, CA (US)

(73) Assignee: Smart Wires Inc., Union City, CA (US)

( * ) Notice: Subject to any disclaimer, the term of this patent is extended or adjusted under 35 U.S.C. 154(b) by 0 days.

(21) Appl. No.: 16/570,858

(22) Filed: Sep. 13, 2019

Related U.S. Application Data

(60) Provisional application No. 62/858,904, filed on Jun. 7, 2019.

(51) Int. Cl.
*H01H 33/42* (2006.01)
*H01H 33/666* (2006.01)
(Continued)

(52) U.S. Cl.
CPC ..... *H01H 33/6664* (2013.01); *H01H 3/3026* (2013.01); *H01H 33/42* (2013.01);
(Continued)

(58) Field of Classification Search
CPC ..... H01H 33/6664; H01H 33/42; H01H 33/6662; H01H 33/66207; H01H 3/3026; H01H 2033/6667
See application file for complete search history.

(56) References Cited

U.S. PATENT DOCUMENTS 6,156,989 A * 12/2000 Miller ..... H01H 33/666 218/120
6,326,872 B1 * 12/2001 Marchand ..... H01H 9/12 218/139

(Continued)

FOREIGN PATENT DOCUMENTS

EP 0354803 2/1990
WO 2004/086437 10/2004

OTHER PUBLICATIONS

Benke, James et al., "Medium Voltage Electro-Mechanical Linear Actuator Breaker", Eaton, downloaded from https://www.eaton.com/content/dam/eaton/products/electrical-circuit-protection/medium-voltage-vacuum-circuit-breakers/mv-vcp-t-vacuum-circuit-breakers/medium-voltage-electro-mechanical-linear-actuator-breaker-ad01301002e.pdf, 5 pp. total, May 7, 2005.

(Continued)

*Primary Examiner* — Truc T Nguyen
(74) *Attorney, Agent, or Firm* — Womble Bond Dickinson (US) LLP

(57) ABSTRACT

An actuator for circuit interrupter has a stationary magnetic boss, a movable magnetic armature and a drive rod. The drive rod is aligned on an axis of the circuit interrupter. The drive rod has two stable positions, circuit interrupter closed and circuit interrupter open. The drive rod has a surface that the armature contacts to move the drive rod from the circuit interrupter closed position to the circuit interrupter open position. In the circuit interrupter closed position, the armature and the surface are separated by a pre-travel distance. The armature is to move towards the stationary magnetic boss and contact the surface, to initiate a circuit interrupter disconnecting motion of the drive rod with a transfer of momentum to the drive rod.

17 Claims, 8 Drawing Sheets

CLOSED

(51) Int. Cl.
*H01H 33/662* (2006.01)
*H01H 3/30* (2006.01)

(52) U.S. Cl.
CPC .. *H01H 33/6662* (2013.01); *H01H 33/66207* (2013.01); *H01H 2033/6667* (2013.01)

(56) References Cited

U.S. PATENT DOCUMENTS 6,870,451 B1 * 3/2005 Inoue ..... H01H 33/6662 335/172
6,930,271 B1 8/2005 Palmieri et al.
6,952,332 B2 * 10/2005 Slade ..... H01H 33/32 218/57
7,280,019 B2 10/2007 Kolb et al.
8,466,385 B1 * 6/2013 Glaser ..... H01H 33/6661 218/140
8,854,165 B2 10/2014 Irwin
9,183,996 B2 * 11/2015 Karlstrom ..... H01H 3/60
9,190,234 B2 11/2015 Reuber
2002/0011147 A1 * 1/2002 Tsubouchi ..... B60T 8/4854 91/376 R
2003/0089683 A1 * 5/2003 Thuresson ..... H01H 3/40 218/154
2004/0093718 A1 * 5/2004 Takeuchi ..... H01F 7/1607 29/602.1
2005/0024174 A1 2/2005 Kolb et al.
2005/0067380 A1 * 3/2005 Rhein ..... H01H 33/6662 218/118
2006/0006146 A1 * 1/2006 Prestini ..... H01H 33/6662 218/154
2006/0197639 A1 9/2006 Opfer et al.
2006/0208591 A1 * 9/2006 Lee ..... H01H 33/6662 310/120
2007/0194872 A1 8/2007 Pfister et al.
2012/0274428 A1 * 11/2012 Reuber ..... H01H 33/6662 335/6
2012/0327549 A1 * 12/2012 Chaly ..... H01H 33/6662 361/160
2013/0009731 A1 * 1/2013 Fong ..... H01H 51/24 335/16
2013/0307652 A1 11/2013 Irwin
2014/0090965 A1 * 4/2014 Leccia ..... H01H 1/0015 200/308
2014/0327502 A1 * 11/2014 Lammers ..... H01H 53/015 335/149
2015/0170857 A1 * 6/2015 Reuber ..... H01H 33/6662 335/153
2016/0181049 A1 * 6/2016 Rallabandi ..... H01F 7/0278 335/38
2017/0236663 A1 * 8/2017 Jung ..... H01H 39/002 218/140
2020/0066468 A1 * 2/2020 Wang ..... H01F 7/081

OTHER PUBLICATIONS

Dullni, Edgar et al., "A Vacuum Circuit-Breaker with Permanent Magnetic Actuator and Electronic Control", ABB Calor Emag Mittelspannung GmbH, 5 pp. total, 1999.
Pei, X. et al., "Fast operating moving coil actuator for a vacuum interrupter", IEEE Transactions on Energy Conversion, pp. 1-10, Apr. 2017.

* cited by examiner

CLOSED

OPEN

OPEN

CLOSED

CLOSED

KINETIC ACTUATOR FOR VACUUM INTERRUPTER

This application claims benefit of priority from U.S. Provisional Application No. 62/858,904, titled "Kinetic Actuator for Vacuum Interrupter" and filed Jun. 7, 2019, which is hereby incorporated by reference.

TECHNICAL FIELD

The technical field of the present disclosure relates to high-voltage switches having linear actuators.

BACKGROUND

Reactance injection into electric power transmission lines offers the opportunity to realize substantial improvements in overall system capacity and in system stability. However, there are some instances, when it becomes appropriate to eliminate the reactance injection totally and completely. These instances typically coincide with faults of one type or another. Grounding, short-circuiting or open circuiting are all types of faults that can devastate a system if not corrected or isolated. Injected reactance can confuse the localization of such faults. A fault might be more localized, like the loss of power or functionality of a reactance injecting apparatus. Since reactance injection systems generally operate in series with the flow of energy through the line, the surest way to eliminate their influence is to provide a switch that will bypass the reactance injecting module, either manually or automatically upon the system's discovery of a failure.

One component that allows the economical and efficient construction of a bypass switch is the vacuum interrupter. This is a component manufactured by many companies, including ABB, Eaton, GE, Siemens, and others. A representative pair of simplified cross sections appears in FIG. 1. The vacuum interrupter component shown in this figure is sometimes referred to as a "bottle," so called because of its hermetically sealed ceramic enclosure 110. At the top of the vacuum interrupter, there is a fixed connector 120, which provides electrical contact to the upper of the two contacts 130 (shown in the closed position) and 132 (shown in the open position.) The lower of the two contacts is accessed via the movable connector 160 (closed), 162 (open). The separation of the contacts in their open position 132 is called the stroke of the switch, and it is obvious that the greater the separation, the more voltage the switch can withstand. In order to open the switch, the movable connector 162 must be drawn downward by the distance the contacts are opened. This compresses a metal bellows 150 or 152, that forms part of the overall vacuum seal. (The shield 140 prevents metal sputtered from the contacts from reaching the ceramic walls 110 of the vacuum interrupter and compromising the electrical insulation between the two ends of the interrupter.) It is the role of the actuator to move the movable connector between its closed 160 and open 162 positions by providing a controlled linear displacement along the axis of the vacuum interrupter.

While a vacuum is a nearly ideal environment for a high-power electrical switch, there are residual risks. Under some conditions of instantaneous voltage at the instant of the switch's closure and roughness of the contacts' surfaces, microscopic welded points may be formed between the fixed and movable contacts (130 in FIG. 1). These increase the energy required to open the switch contacts beyond its normal range of values.

Within the switch, the size and surface of the contacts 130 determine the switch's current handling characteristics. All other aspects of the switch or bypass switch performance are determined by the actuator, including the stroke that defines the operating voltage, the interrupter's resting condition, which is typically one of normally ON, normally OFF, or its most recent state.

To utilize a bypass switch in the context of a powerline reactance injector, the requirements of that application must be satisfied. The prescribed role of the interrupter is to activate the injector by having the switch open and to bypass the injector when the switch is closed. Thus, the passive state is "switch closed," i.e., this application calls for a normally closed switch. Further, in the event of a power failure the actuator should place the interrupter in the passive "switch closed" state automatically without any signal or power. Finally, the typical operating conditions for a reactance injector require that the switch be open, and in this state, the actuator must operate at a low power level to minimize heating. Therefore, there is a need in the art for a solution which overcomes the drawbacks described above.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention will be apparent from the following detailed description taken in conjunction with the accompanying drawings.

It will be appreciated that the schematic drawings illustrate the principles of the invention without showing all structural elements, connectors or protective elements.

DETAILED DESCRIPTION

The activator described in this disclosure enables a bypass switch that satisfies these operational requirements and adds a level of reliability to the transition from contacts closed to contacts open.

Figure 2:
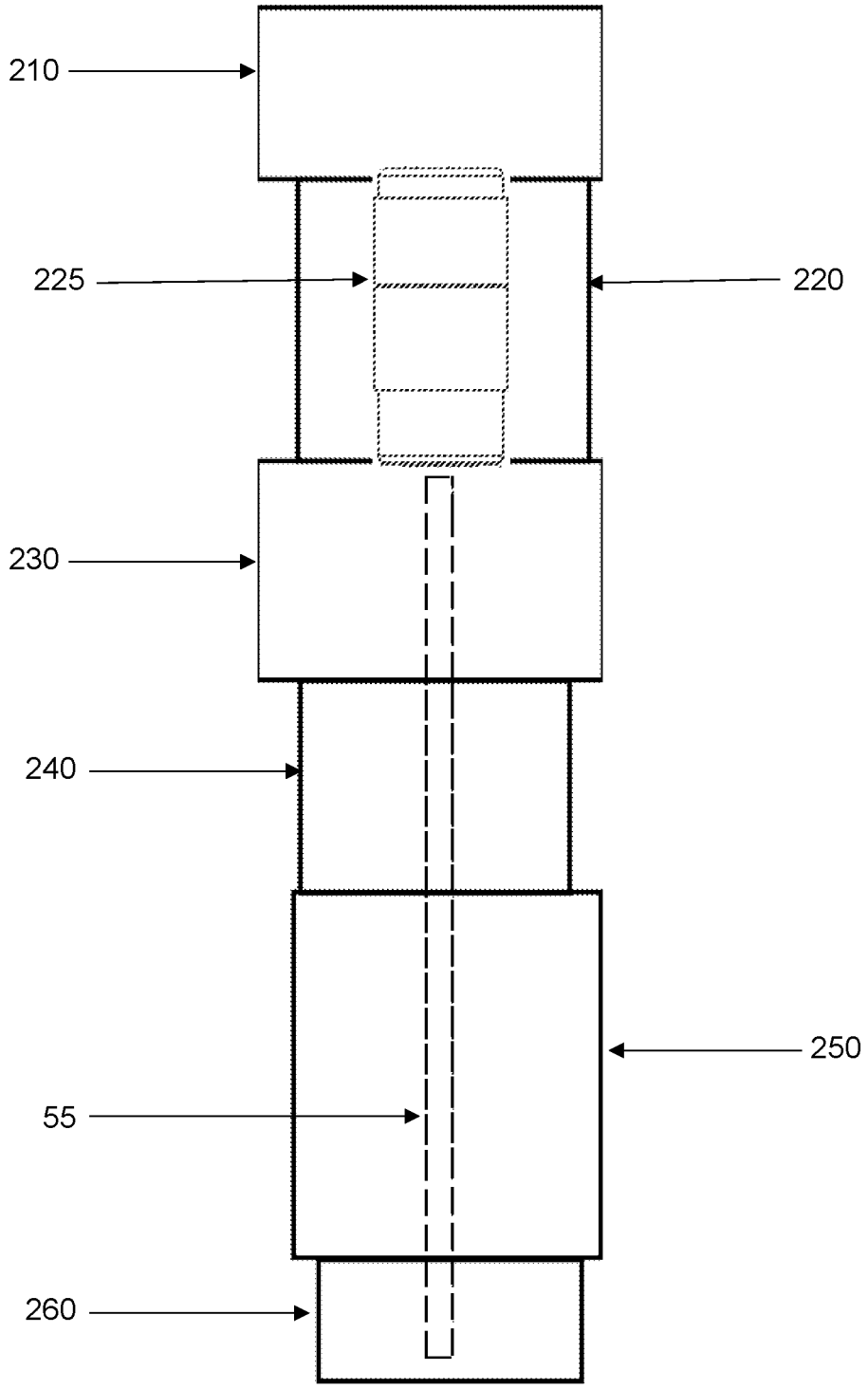
FIG. 2 is a block diagram of the elements of a complete bypass switch, including an actuator.

There are several sections to a bypass switch, as illustrated in FIG. 2. The vacuum interrupter 225 with the contacts sealed in a vacuum is housed, protected and insulated in the region marked 220. Above that is the contact 210 between the line to be switched and the top, stationary contact of the vacuum interrupter 225. Region 230 provides contact between the line to be switched and the movable end of the vacuum interrupter 225. Region 240 provides isolation between the high voltage contact in region 230 and the balance of the bypass switch. This isolation may allow the separation of different voltages or different atmospheres.

The focus of the present disclosure is region 250, the activator. Its role is to move the drive rod 55 up or down in a controlled fashion according the electrical signals applied or not applied to the activator. This motion is applied to the movable end of the vacuum interrupter 225, opening, closing or holding the switch contacts (130 or 132 in FIG. 1) in a desired position. Drive rod 55 is illustrated as a single, homogeneous structure in order to clarify its role in transferring motion up or down from the activator in region 250. As a practical matter, the drive rod 55 will be composed of different pieces comprising different materials and different cross-sections in order to satisfy the need for adjustability and isolation along its length, and it may include mechanical buffers. It remains aligned along the axis of the vacuum interrupter 225.

The final region in FIG. 2 is the monitor in region 260. This region 260 is optional in some embodiments, but it may be desirable to electrically verify the position of the drive rod 55, which may be extended into the monitor region 260. Within that region 260 one may employ monitoring that is a simple as a microswitch operated by a cam on the drive rod, or it could be as complex as a laser interferometer measuring the drive rod's position.

Figure 3:
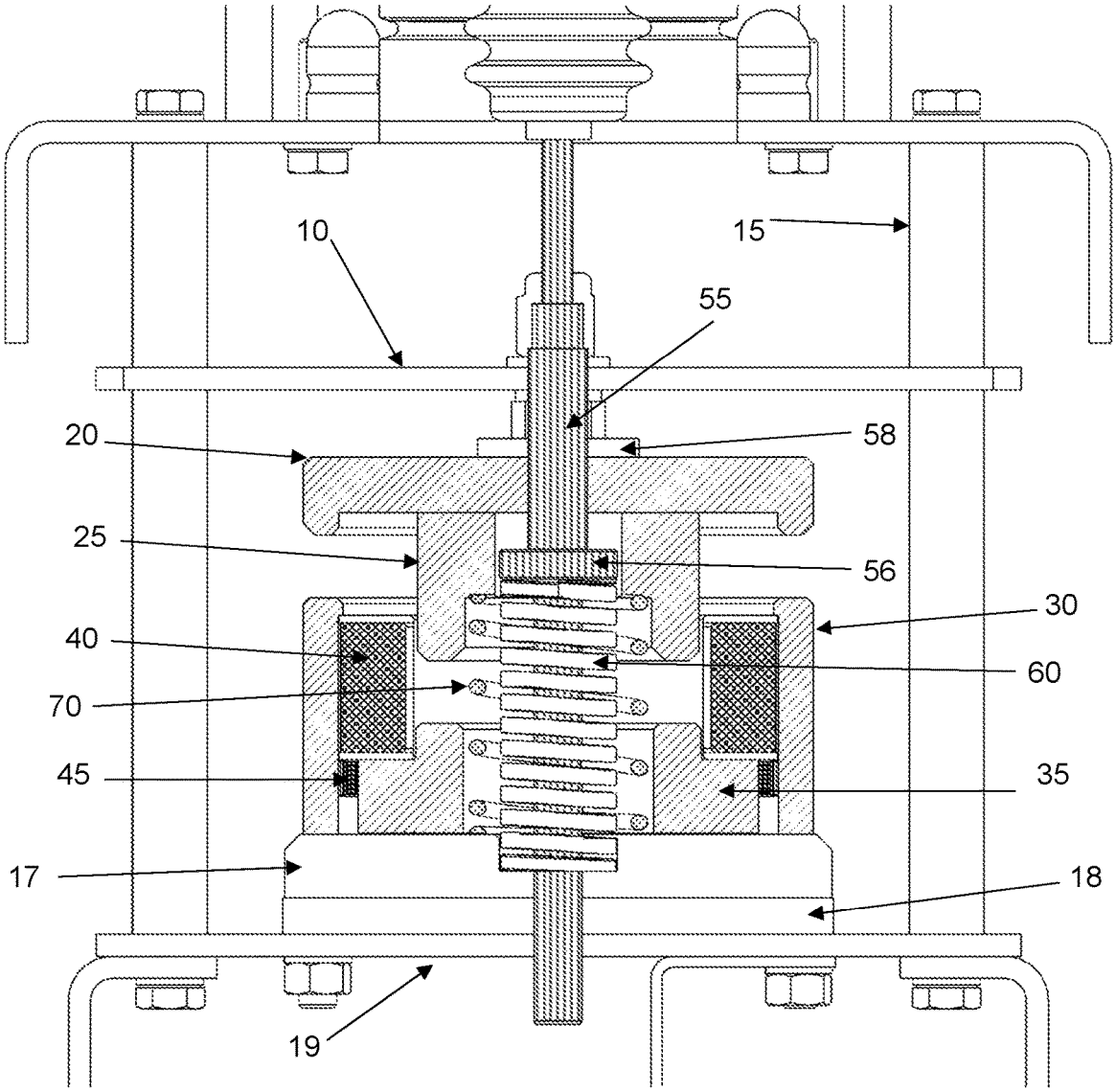
FIG. 3 is a schematic cross section of the described actuator in its switch-closed condition.
Figure 4:
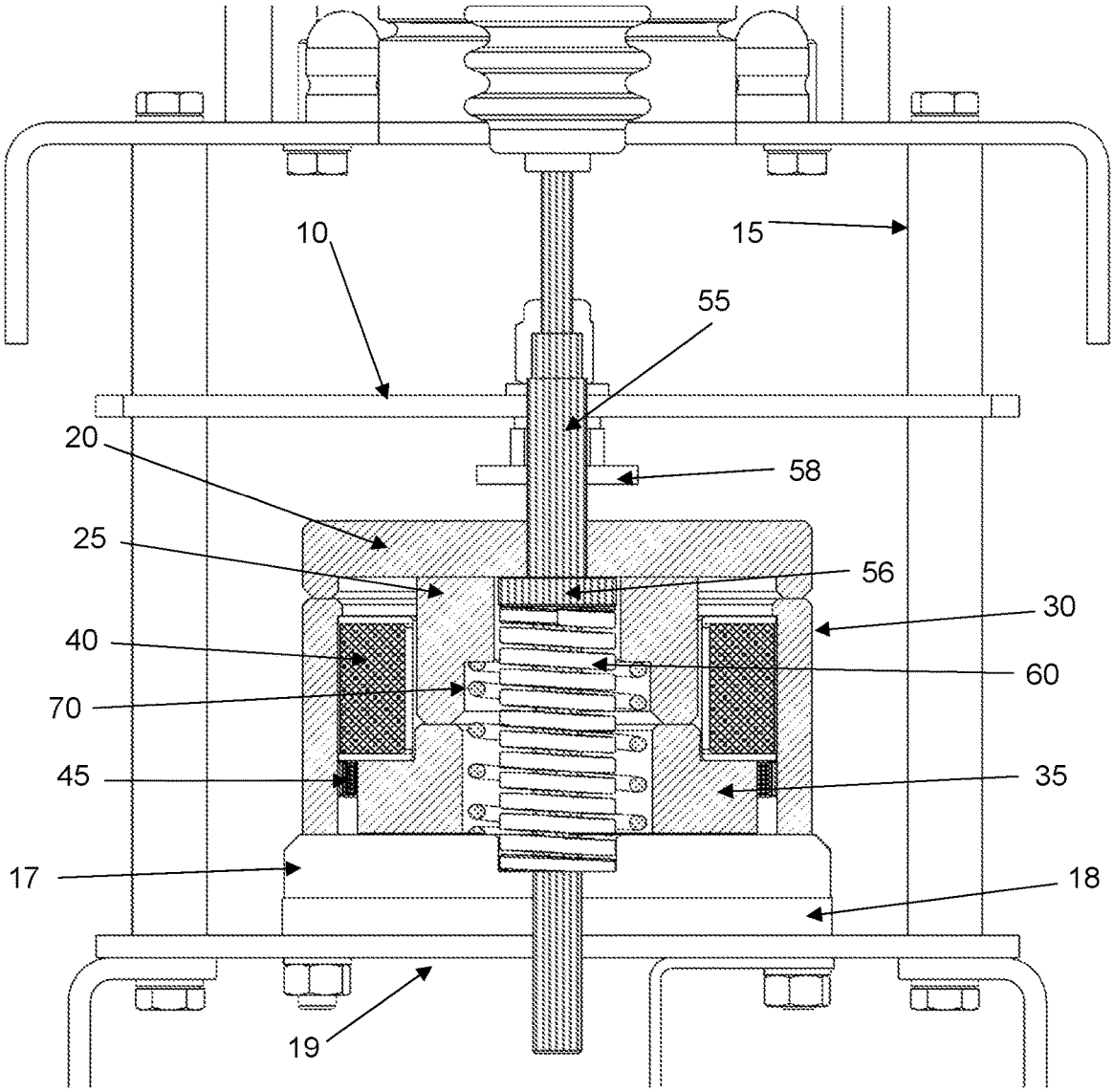
FIG. 4 is a schematic cross section of the described actuator in its switch-open condition.

The essence of the activator is illustrated in FIGS. 3 and 4; both are partial and schematic cross sections of the activator structure. FIG. 3 portrays the activator in the closed or ON position. This is a case where the drive rod 55 is in its most upward position, and where the contacts in the evacuated enclosure, the vacuum interrupter are forced together so they can carry current between the two lines cited in FIG. 2. The lateral motion of the drive rod 55 is constrained by a guide plate 10, riding on guide rails 15. The non-magnetic metal structural support members 17, 18 and 19 (which could be support plates) provide mechanical support to the magnetic structures that dominate the activator.

The first magnetic (i.e., able to be magnetized) structure is the armature, shown here in two armature pieces 20 and 25. While FIG. 3 shows them in cross section, they are circular armature piece 20 or cylindrical armature piece 25 as viewed along the axis of the drive rod 55. The armature 20, 25 could also be composed of a single piece of ferromagnetic material, eliminating the seam between armature piece 20 and armature piece 25. The ferromagnetic material forming the armature 20, 25 should be a metal like Permalloy, soft carbon steel or electrical steel, having a low level of coercivity, less than 160 A/m, to assure the responsiveness of the magnetic circuits.

The other elements of the magnetic circuit in FIG. 3 are a magnetic case 30 and a magnetic boss 35. These elements are also preferably formed of low coercivity ferromagnetic metals. Permalloy, soft carbon steel and electrical steel are all materials with coercivities less than 160 A/m. Either a single cylindrical permanent magnet 45 or a ring of smaller magnets 45 are positioned between the magnetic case 30 and the magnetic boss 35. The magnetism of permanent magnet(s) 45 must be oriented so that the magnetic lines of force point radially, perpendicular to the drive rod 55. Anticipating FIG. 5, the magnetization of these permanent magnets 45 will be oriented such that the outer surfaces are all North poles as a specific example. Various embodiments are agnostic with respect to having North poles or South poles on the outer surfaces.

The other key element in the magnetic configuration is the solenoid 40. This one coil is used both to open the interrupter and to hold it in the open position. In every instance the solenoid 40 is driven so its induced magnetic field is in the same direction as the field induced by the permanent magnet 45, e.g., a permanent magnet ring. The permanent magnet 45 and the solenoid 40 fields are additive. The solenoid 40 normally has several components, the most important of which are windings of wire, but there are connections, a bobbin, and insulation. These are commonly used and incidental to the activator operations being described.

The drive rod 55 is axially movable with respect to structural support members 17, 18, and 19, and movable with respect to the magnetic case 30 (e.g., a housing), the magnetic boss 35 and the solenoid 40. With the activator in the closed condition, with the drive rod 55 in its upward position, the force on the vacuum interrupter is established by the principal spring 60, which bears on the collar 56 of the drive rod 55. There is a second spring 70 that holds the armature 20, 25 in its upward, reset position. The upper portion of the armature, armature piece 20, is free to move along the drive rod 55, but its motion is limited at one extreme by contacting the collar 56, and at the other extreme it is limited by a stop 58 that is attached to or integrated with the drive rod 55.

Figure 1:
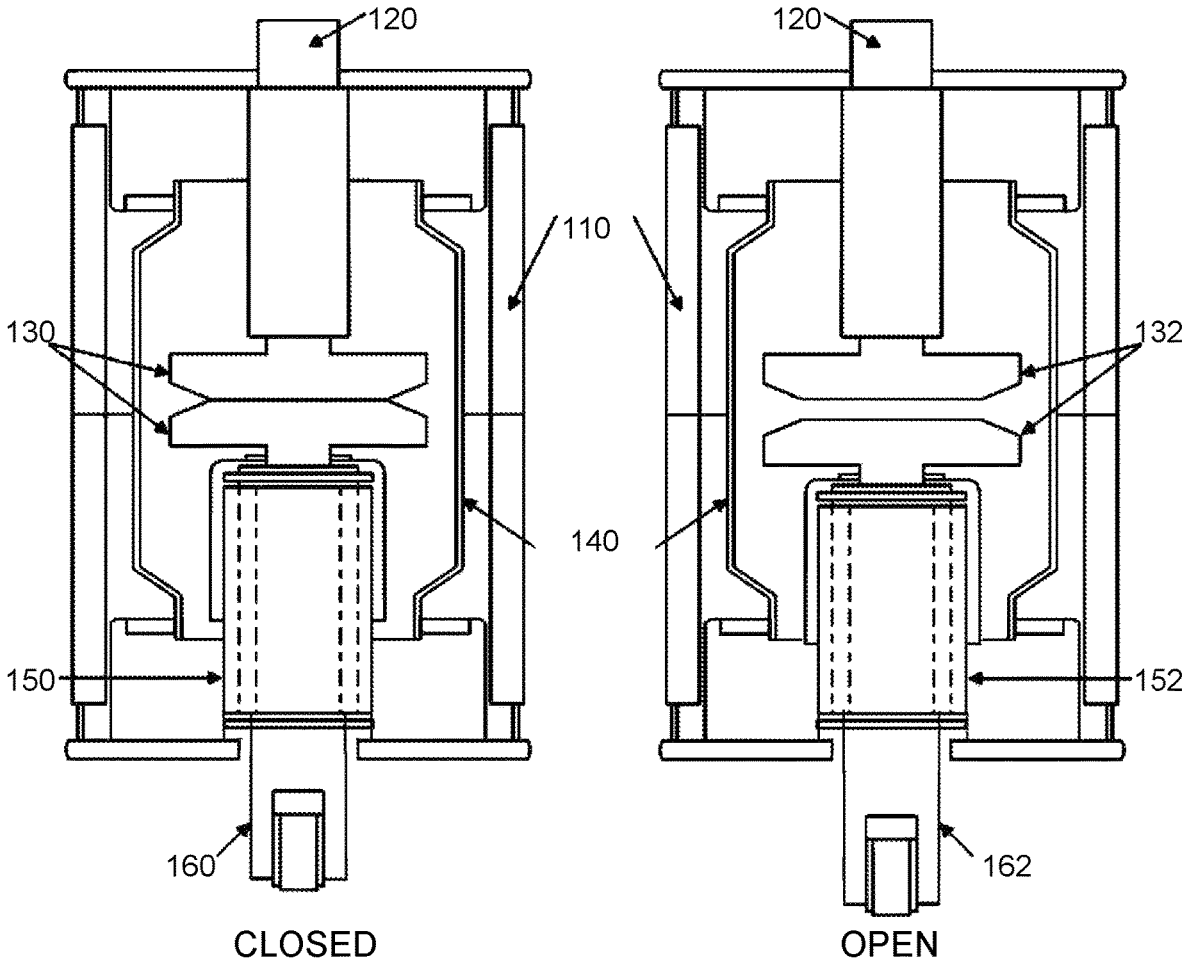
Prior Art FIG. 1
FIG. 1 is a simplified cross section of a vacuum interrupter component.

The conditions illustrated in FIG. 3 pertain when there is no power applied to the activator. The drive rod 55 is in its uppermost position, holding the contacts 130 in the vacuum interrupter together in a CLOSED position as shown in FIG. 1, completing a circuit between the two external line contacts. In order to open the switch, DC power must be applied to the solenoid 40 in a sense to augment the magnetic field imposed by the permanent magnet 45, e.g. the permanent magnet ring. For a solenoid 40 of 360 turns, a current of 30 to 40 amperes provides enough attraction to overcome the upward pressure of first the armature reset spring 70, and then subsequently the principal spring 60, drawing the armature 20, 25 downward, culminating in the condition illustrated in FIG. 4. Example forces overcome by the solenoid 40 are approximately 150 N from the armature reset spring 70 plus approximately 3000 N from the principal spring 60.

FIG. 4 shows the activator in a condition to hold the contacts 132 in the vacuum interrupter open as shown in FIG. 1 OPEN. In FIG. 4, the numbering of each component is identical to the numbering in FIG. 3. In this open position, the upper portion of the ferromagnetic armature, armature piece 20, is in contact with the magnetic case 30, and the inner portion of the armature, armature piece 25, is in contact with the magnetic boss 35. In this position the armature piece 20 bears on the collar 56 of the drive rod 55, holding it down. This corresponds to the contacts 132 in FIG. 1 being separated, opening the circuit. In this position, the armature reset spring 70 and the principal spring 60 are both exerting upward force on the armature 20, 25.

Figure 5:
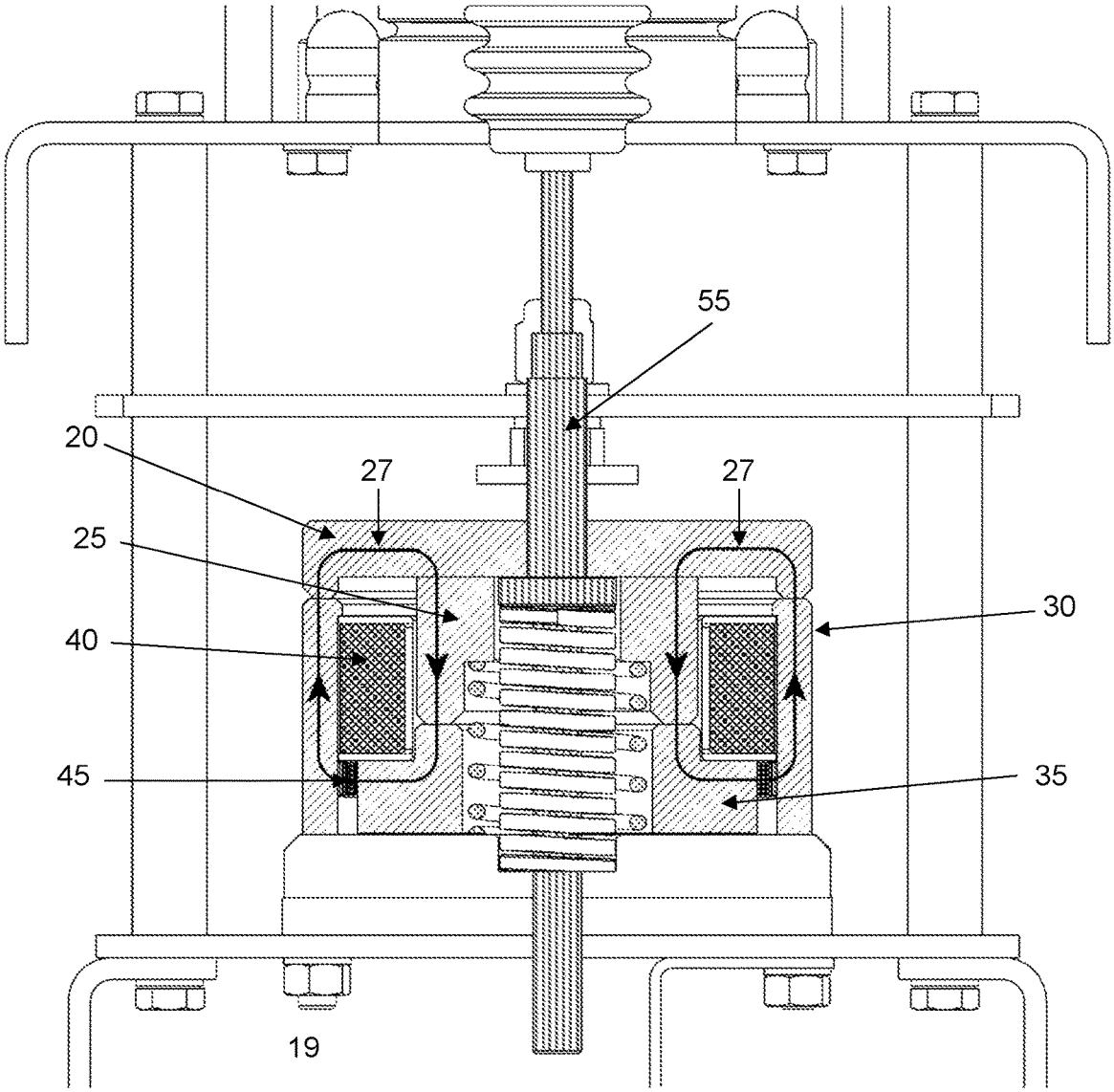
FIG. 5 is a schematic cross section of the actuator in its switch-open condition, illustrating the magnetic holding circuit.

In the open condition, illustrated again in FIG. 5, the upper portion of the armature, i.e., armature piece 20, the magnetic case 30, the permanent magnet 45, the magnetic boss 35 and the inner portion of the armature, i.e., armature piece 25, form a magnetic circuit 27, which has a very low reluctance because the materials of the armature 20, 25, the magnetic case 30 and the magnetic boss 35 are all chosen to have high permeability. For this purpose, a high permeability would be 100 or more times the permeability of free space. This closed magnetic circuit assures that the magnetomotive force of the permanent magnet(s) 45 and the solenoid 40 result in high values of flux density, creating strong attractive forces between the faces of the upper armature piece 20 and the magnetic case 30, and between the magnetic boss 35 and the inner armature piece 25.

There are two extreme methods of maintaining the switch open condition illustrated in FIG. 5. The first would be to have current running through the solenoid at a level sufficient to withstand the total upward forces exerted by the principal spring 60 and the armature reset spring 70. The other extreme would be to design the permanent magnet 45 to have enough magnetomotive force to hold the armature 20, 25 in contact with the magnetic case 30 and magnetic boss 35. This option is not acceptable because the operational requirements include having the actuator take its closed condition in the absence of applied power.

Numerical examples contained in the following paragraphs are illustrative for a 15 KV, 2000 ampere vacuum switch, with a 65,000 ampere peak transient current rating. Higher ratings would generally require more force, stronger magnetics and more operating current.

This actuator uses a permanent magnet 45 only strong enough to provide 45% to 55% of the total force exerted by the springs 60 and 70, e.g., 3400 N. Holding the activator in the open position requires, in addition to the force of permanent magnet 45, the magnetomotive force of a current between 1 ampere and 3 amperes passing through the solenoid 40. Note that this current represents a solenoid power that is roughly 25% of the power required without the permanent magnet 45. More impressively, it is a very small fraction, approximately 0.3% of the power required during the transition from closed to open. These specific numbers are examples; smaller or larger switch vacuum interrupters would require less or more energy for transitions and holding, but the use of a permanent magnet significantly reduces the power necessary to hold the actuator in a contacts-open condition, additionally reducing the energy needed to drive the contacts from closed to open, albeit, to a lesser extent. The specific values of the currents are affected by the choice of the ferromagnetic materials, the number of turns in the solenoid, and the strength of the permanent magnets. It remains essential in some embodiments that the restraining force of the permanent magnet 45 is insufficient to hold the armature 20, 25 in its switch-open condition. There must be additional magnetic force from a holding current in the solenoid 40 to sustain the bypass switch in its open condition.

Figure 6:
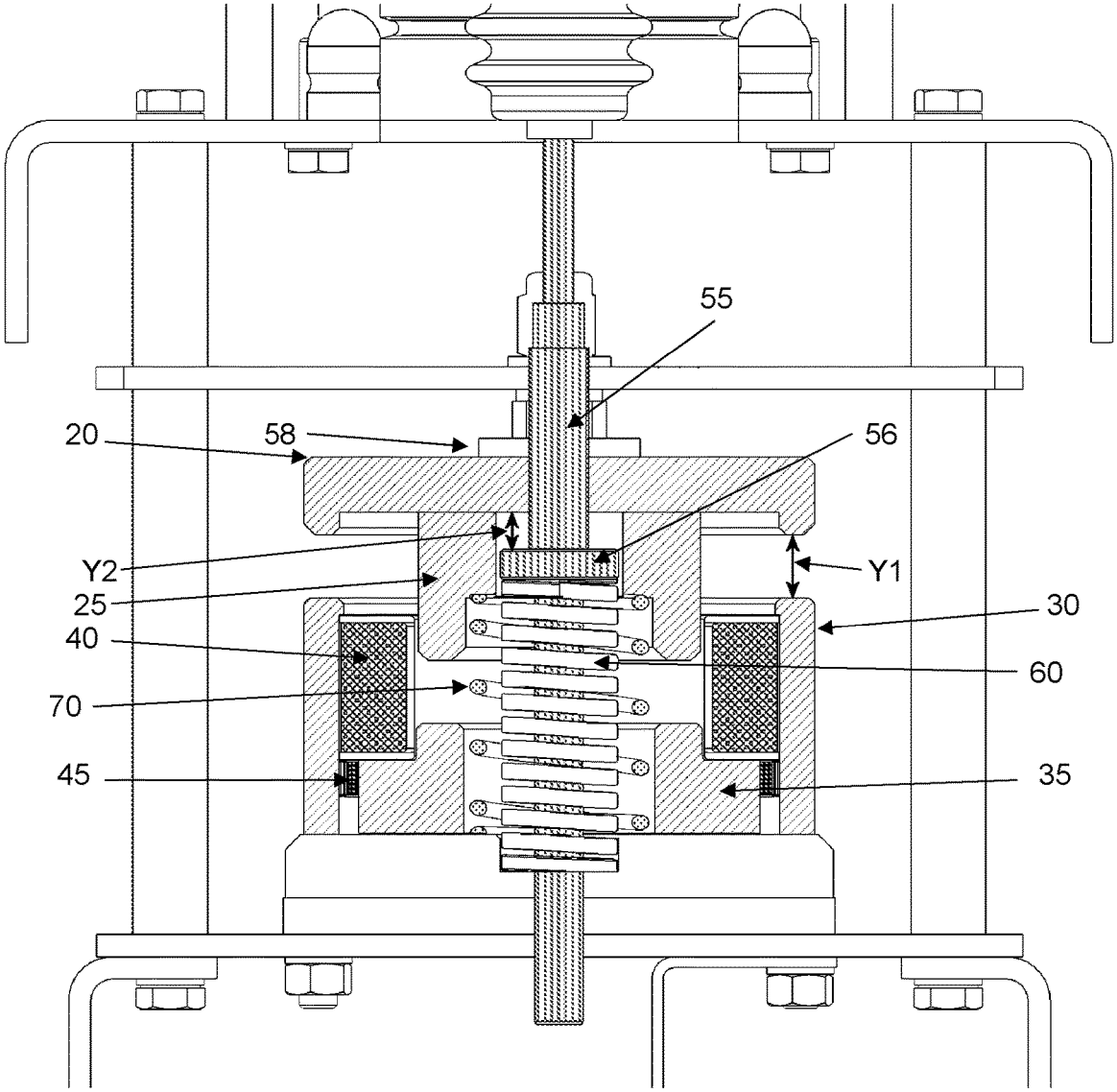
FIG. 6 is a schematic cross section of the actuator in its switch-closed condition illustrating the distances associated with pre-travel of the armature.

The transition from contacts closed to contacts open is addressed with the aid of FIG. 6, which shows the actuator in the contacts-closed condition. The armature 20, 25 is stopped by the stop 58, which is fixed in relation to the drive rod 55, leaving a spacing identified as Y1 between the mating faces of the upper portion of the armature, i.e., armature piece 20, and the magnetic case 30. That same spacing Y1 exists between the inner portion 25 of the armature and the magnetic boss 35. With the contacts closed, there is a spacing identified as Y2, between the surface of the upper armature piece 20 and the collar 56 of the drive rod 55. In the transition from closed to open, as soon as the solenoid 40 is activated, the armature 20, 25 will start moving downward, resisted by the relatively weak armature reset spring 70 through a distance Y2, pre-travel before the motion of the drive rod 55 and its collar 56 commences. In this travel, the mass of the armature 20, 25 accumulates velocity, such that the motion of the drive rod 55 and its collar 56 starts with a transfer of momentum from the moving armature 20, 25. This jerk provides extra kinetic energy during the opening of the contacts (130 in FIG. 1), and this extra kinetic energy breaks any micro-welded points on the contact faces.

The net stroke applied to the vacuum interrupter is the total travel Y1 of the armature 20, 25 diminished by the pre-travel Y2. An example value of Y1 is 17 mm, and a representative value of Y2, pre-travel, is 10 mm. The net stroke applied to the vacuum switch is 7 mm in this example. The net stroke is a design parameter of the system, with longer strokes accommodating higher operating voltages for the switch and shorter strokes minimizing metal fatigue and extending the operating life of the vacuum switch.

Figure 7:
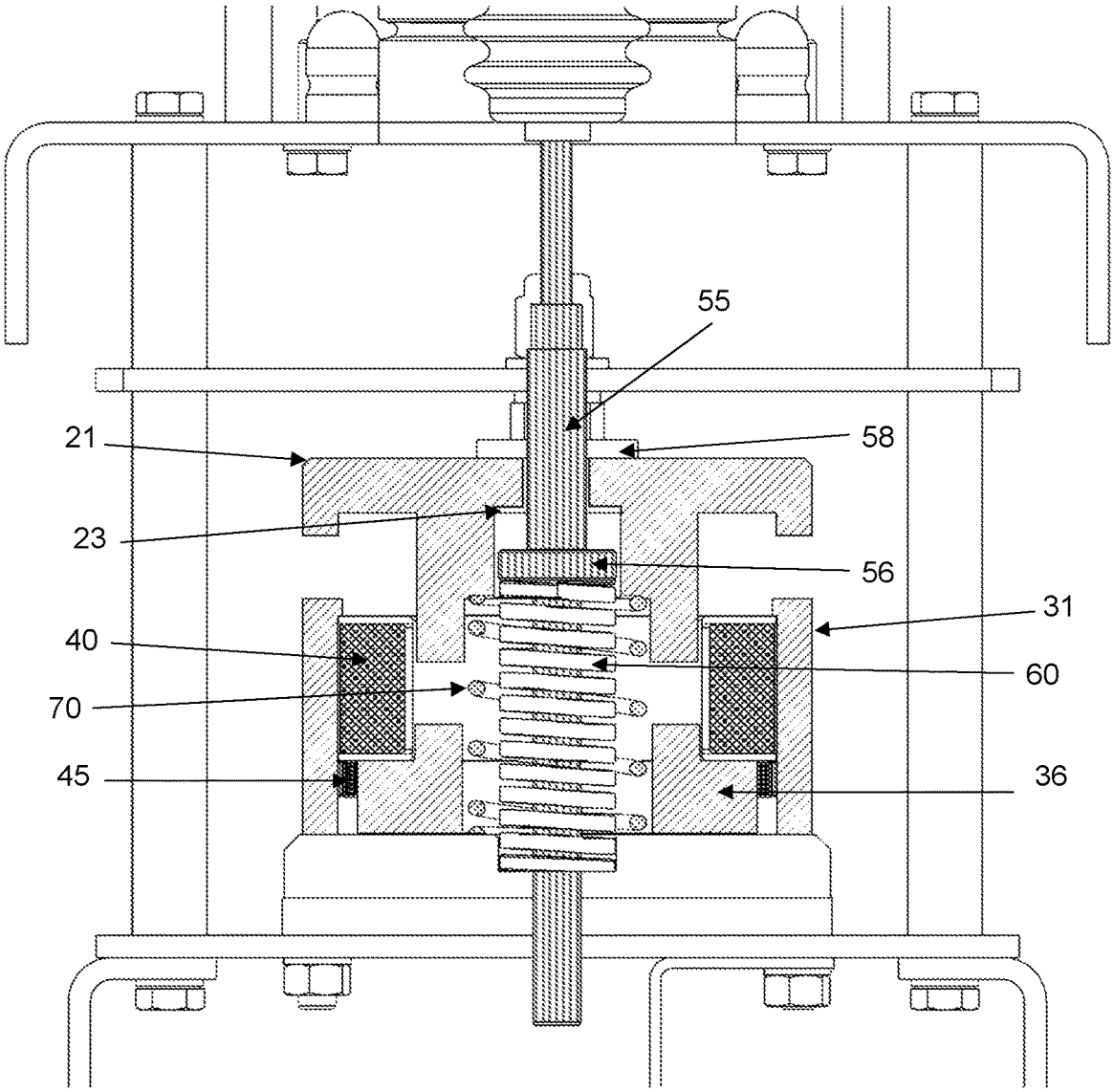
FIG. 7 is a schematic cross section of an actuator realized in a rectilinear or magnetic sheet construction.

FIGS. 3 through 6 above have all depicted the magnetic elements, armature 20, 25, magnetic case 30 and magnetic boss 35 as being circular or cylindrical as observed on the axis of the drive rod 55 and constructed of solid ferromagnetic alloys. The circular construction is advantageous in its being insensitive to incidental rotations about the axis of the drive rod 55. The principles laid out above are equally applicable to magnetic elements that are rectangular or square when viewed along the axis of the drive rod 55. FIG. 7 shows a schematic cross section of an activator with the magnetic elements armature 21, magnetic case 31 and magnetic boss 36 all having rectilinear outlines. While forming the armature 21, the magnetic case 31 and the magnetic boss 36 from solid ferromagnetic materials is feasible, it is also possible to form them from thin sheets of ferromagnetic metal, as is commonly done with transformers. Thus, some or all of the armature 21, the magnetic case 31 and the magnetic boss 36 may be realized as stacks of thin ferromagnetic sheets, having the cross sections visible in FIG. 7.

If sheet materials are used, an additional bushing 23 may be used to protect the sheet edges from the motion relative to the drive rod 55 and the impact with the collar 56. Further, the rectangular geometry requires additional guiding so any incidental rotations of the armature 21 about the axis of the drive rod 55 are too small to affect the integrity of the magnetic circuits formed when the actuator is in its switch-open condition. The incidental rotations must also be confined to avoid having the armature 21 touch the solenoid 40 or any of its protective elements. The drive rod 55 and collar 56 must be centered in the armature 21 to avoid twisting during opening and closing operations.

Figure 8:
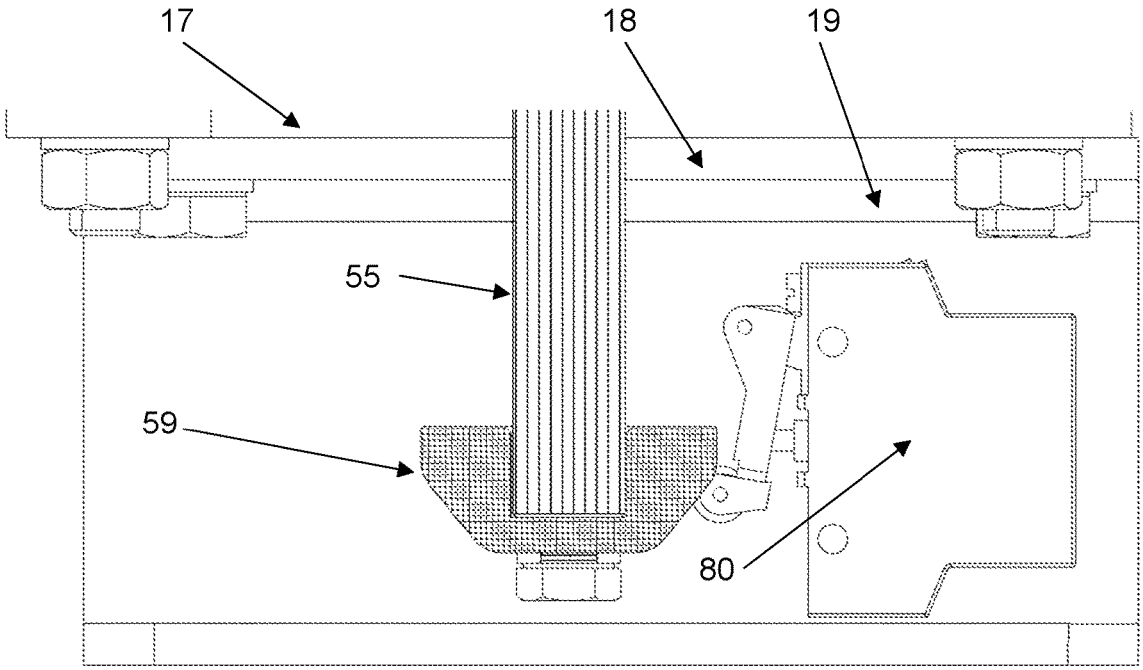
FIG. 8 is a schematic cross section of a microswitch based position monitoring method.

In embodiments shown in FIG. 3 and FIG. 4, the drive rod 55 extends below the structural support members 17, 18 and 19. This extension makes it possible to place a position monitoring element below those plates. This is schematically illustrated in FIG. 8. The simplest position indicator may be formed from a shaped cap 59 on the drive rod 55. This cap may act as a cam to depress one or more microswitches 80 when the drive rod 55 is in its lower, contacts-open position. Correspondingly, the microswitch is released when the drive rod 55 is in its upper, contacts-closed position. Other indicating methods may be employed. Examples include optical sensing of light or dark patterns on the drive rod 55, or laser sensing of one or more gratings on the drive rod 55.

What is claimed is:

1. An actuator for a circuit interrupter, comprising:

a stationary magnetic boss;

a movable magnetic armature; and a drive rod aligned on an axis of the circuit interrupter, the drive rod having two stable positions, circuit interrupter closed and circuit interrupter open, and a surface, located on the drive rod between the movable magnetic armature and the stationary magnetic boss, so that the armature contacts the surface to move the drive rod from the circuit interrupter closed position to the circuit interrupter open position;

wherein, in the circuit interrupter closed position, the armature and the surface are separated by a pre-travel distance, such that the armature is to move towards the stationary magnetic boss and contact the surface, to initiate a circuit interrupter disconnecting motion of the drive rod with a transfer of momentum to the drive rod.

2. The actuator of claim 1, wherein a range of travel for the driver rod and a switch contact of the circuit interrupter is less than a range of travel for the armature.

3. The actuator of claim 1, arranged for a hermetically sealed circuit interrupter that includes permanent magnets between a magnetic housing and the magnetic boss.

4. The actuator of claim 1, arranged for a hermetically sealed circuit interrupter that includes a DC solenoid within a magnetic housing that is sized to allow the magnetic armature to move within the solenoid in response to current passing through the solenoid.

5. The actuator of claim 1, arranged for a hermetically sealed circuit interrupter that holds the drive rod in the circuit interrupter closed position in absence of applied power.

6. The actuator of claim 1, arranged for a hermetically sealed circuit interrupter that utilizes one or more springs to hold the drive rod in the circuit interrupter closed position in absence of applied power.

7. The actuator of claim 1, arranged for a hermetically sealed circuit interrupter that utilizes one or more springs to change the drive rod from the circuit interrupter open position to the circuit interrupter closed position with removal of applied power.

8. The actuator of claim 1, having a combination of permanent magnet force and magnetic force of a DC solenoid to effect a transition from contacts of the circuit interrupter closed to the contacts of the circuit interrupter open.

9. The actuator of claim 1, having a combination of permanent magnets, a DC solenoid and a magnetic circuit to maintain contacts of the circuit interrupter open.

10. The actuator of claim 1, having a combination of permanent magnets, a DC solenoid and a magnetic circuit to maintain contacts of the circuit interrupter open using a designated low power level in the solenoid.

11. The actuator of claim 1, having a magnetic circuit comprising a stationary magnetic housing with a pole, the stationary magnetic boss with an opposite pole and the movable magnetic armature with outer and inner poles that mate with corresponding poles on the magnetic housing and the magnetic boss to complete the magnetic circuit when the drive rod is in the circuit interrupter open position.

12. The actuator of claim 1, wherein a solenoidal magnetic field and a permanent magnetic field have a same orientation, avoiding tendency of activating fields to demagnetize a permanent magnet of the actuator.

13. The actuator of claim 1, wherein, in the circuit interrupter open position, a combination of permanent magnetic force and magnetic force of a solenoid operating at a designated low power level exceed a sum of restoring forces of a spring pressing on the armature and a further spring pressing on the drive rod.

14. The actuator of claim 1, wherein, in the circuit interrupter open condition, a permanent magnetic force is less than a sum of restoring forces of a spring pressing on the armature and a further spring pressing on the drive rod.

15. The actuator of claim 1, wherein a stationary magnetic housing, the magnetic boss and the movable magnetic armature each have a cylindrical shape.

16. The actuator of claim 1, wherein a stationary magnetic housing, the magnetic boss and the movable magnetic armature each have a rectangular shape.

17. The actuator of claim 1, wherein a stationary magnetic housing, the magnetic boss and the movable magnetic armature have rectangular shapes fabricated from sheet magnetic materials.

* * * * *